United States Patent [19]

Lin

[11] Patent Number: 5,010,749

[45] Date of Patent: Apr. 30, 1991

[54] LOCKING DEVICE FOR AN AUXILIARY LOCK

[75] Inventor: Jui C. Lin, KangShan, Kaohsiung, Taiwan

[73] Assignee: Taiwan Fu Hsing Industry Co., Ltd., Hsien, Taiwan

[21] Appl. No.: 555,606

[22] Filed: Jul. 23, 1990

[51] Int. Cl.[5] ..... E05B 9/04

[52] U.S. Cl. ..... 70/190; 70/379 R; 70/381; 70/449; 70/224

[58] Field of Search ..... 70/DIG. 7, 284, 285, 70/379 R, 379 A, 381, 190–191, 448, 449, 452, 224, 134

[56] References Cited

U.S. PATENT DOCUMENTS 2,078,168 4/1937 Stone et al. ..... 70/285

2,135,323 11/1938 Brantingson ..... 70/379 R 2,213,262 9/1940 Segal ..... 70/379 R

FOREIGN PATENT DOCUMENTS 154305 11/1920 Canada ..... 70/284

*Primary Examiner*—Gary L. Smith

*Assistant Examiner*—Darnell M. Boucher

*Attorney, Agent, or Firm*—Fleit, Jacobson, Cohn, Price, Holman & Stern

[57] ABSTRACT

A locking device for an auxiliary lock comprising a rotatable ring and a base. The ring is fitted around the auxiliary lock and combined with the base. Then they are mounted in the door to let a large part of the rotatable ring be exposed outside the door, and rotating the ring can cause the dead bolt of the auxiliary lock to extend out locking the lock.

6 Claims, 3 Drawing Sheets

LOCKING DEVICE FOR AN AUXILIARY LOCK

BACKGROUND OF THE INVENTION

A traditional auxiliary lock 1, as shown in FIG. 1, is mounted in a door from the inside, having a key hole (not drawn in the Figures) at the outside of the lock for a key to turn an actuating plate 11 to rotate a turning button for pushing out or pulling in a dead bolt to lock or unlock it. Said turning button is mounted at the inside of a door, also possible to be rotated from the inside of a door to turn the actuating plate 11 to push out or pull in the dead bolt. This kind of auxiliary lock needs a correct key if it is to be locked from the outside of the door.

SUMMARY OF THE INVENTION

The object of this invention is to provide a kind of locking device for an auxiliary lock, which can be locked either with a correct key or with a rotatable ring from the outside of a door, making the lock more convenient in practical use.

The locking device for an auxiliary lock in the present invention comprises a rotatable ring, a base and an actuating wheel to be combined with a traditional auxiliary lock.

The rotatable ring is provided with teeth around its inner peripheral face at the inner side and an outer peripheral lip at the outer side.

The actuating wheel is provided with a tooth extending up from a flange provided with three notches spaced apart for 90° between each two of them and a cross hole at the bottom.

The base is provided with a round opening for the actuating wheel to fit and rotate therein and is to be combined with the vertical inside of the rotable ring after said ring is fitted around the auxiliary lock.

The tooth of the actuating wheel engages with one of the teeth in the rotatable ring after both are assembled together so that rotation of said ring can rotate said wheel. But said wheel and said ring do not have the same center for rotation, thereby the tooth of said wheel can separate from the teeth of said ring when said wheel is rotated nearly 90°. As the actuating plate of the auxiliary lock passes through the cross hole in said wheel, the 90° rotation of said wheel can cause said plate to rotate for 90° also so that the dead bolt combined with said plate can be extended out for locking the lock. In addition, when said wheel is rotated for 90°, the pointed tip of a V-shaped spring sticks in one of the notches in the flange of said wheel keeping it firmly immovable at its position.

In short, this locking device can lock the auxiliary lock by rotating for 90° the rotatable ring from the outside of a door without using a correct key, and further rotation of said ring in any direction can never unlock the auxiliary lock once it is locked. Then, either using a correct key from the outside or the turning button from the inside can unlock it.

DETAILED DESCRIPTION OF THE INVENTION

Figure 1:
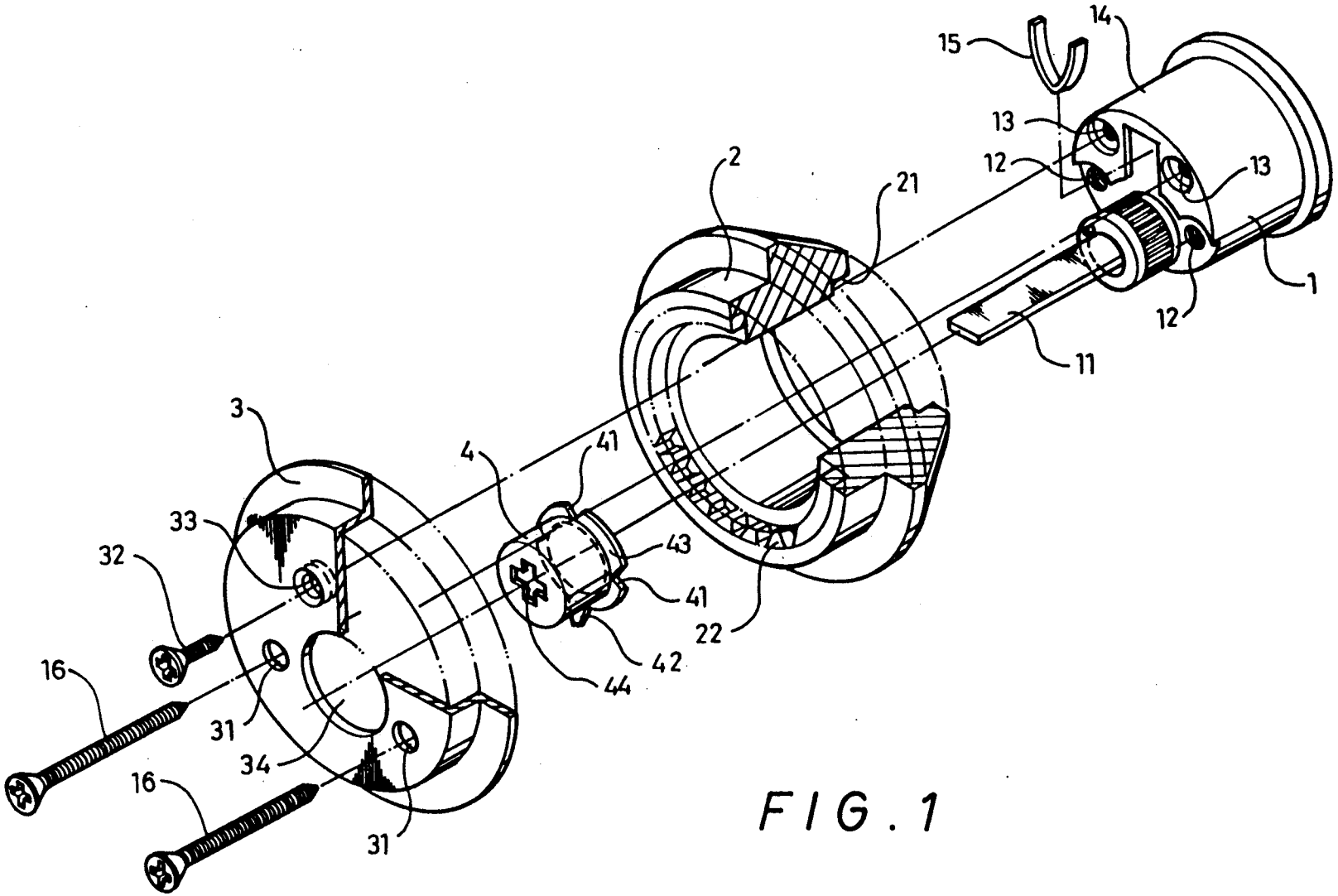
FIG. 1 is an exploded perspective view of the locking device for an auxiliary lock in the present invention.

As FIG. 1 shows, the locking device for an auxiliary lock in the present invention comprises a rotatable ring 2, a base 3 and an actuating wheel 4 to be combined with a traditional auxiliary lock 1. The actuating plate 11 of the lock 1 goes through the dead bolt (not drawn out in the Figures), and the lock 1 is additionally provided with two female-threaded holes 12 for screws 16 to pass through from the inside of a door through holes 31 in the base 3 so that said screws can fix this locking device with the lock 1 together on a door.

The lock 1 is also additionally provided with screw holes 13 for screws 32 to pass through to screw in holes 33 in the base 3 to assemble the base 3 with the lock 1 so that the lock 1 can not be illegally broken and taken off after mounted in a door. The lock 1 is also provided with a recessed opening 14 for a V-shaped spring 15 to stick therein so that the two ends of the spring 15 may stick at the upper edge of the opening wall and its pointed tip engages downward in one of three notches 41 of the actuating wheel 4 so that the wheel 4 can be stabilized firmly at its position.

The rotatable ring 2 has a peripheral lip 21 at the right end and inner teeth around the inner peripheral face at the left end. The lip 21 has its inner edge contacting with the outer flange of the lock 1 after the rotatable ring 2 is fitted around the lock 1, while one of the teeth 22 engages with a tooth 42 in the actuating wheel 4 when the wheel 4 is combined with the rotatable ring 2.

The base 3 has to be combined with the rotatable ring 2 before combined with the lock 1, and is provided with holes 33 for screws 32 to pass through combining the base 3 with lock 1, and two holes 31 for screws 16 to pass through so that the screws 32 can fix and stabilize from the inside of the door the lock 1 and said base 3 together after the lock 1 is assembled with the rotatable ring 2. The base 3 is also provided with a round opening 34 for the actuating wheel 4 to fit and rotate therein.

The actuating wheel 4 fits and rotates in the opening 34 in the base 3, having a flange 43 to contact with the inner peripheral edge of the opening 34 so that the actuating wheel 4 may not fall off the base 3. In addition, the flange 43 has a protruding outward sidewise tooth 42 to engage with one of the teeth 22 of the rotatable ring 2. As the centers of the actuating wheel 4 and the rotatable ring 2 are not the same, the actuating wheel can only be rotated less than 90° when said wheel 4 is rotated by said ring 2. If said wheel 4 is rotated more than 90°, the tooth 42 can be separated or disengaged from the teeth 22 of said ring 2, and thereby said wheel 4 can only rotate for 90° at most and be stabilized at its position when rotated for 90°. The flange 43 is also provided with three notches 41 spaced apart for 90° between each two of them, and each notch can receive the pointed tip of the V-shaped spring 15 to be stabilized immovable in its position. Therefore, when the actuating wheel 4 is rotated nearly 90°, it can be moved to and stop at the accurate position of 90° angle by means of the V-shaped spring 15 sticking in one of the notches 41. Besides, the actuating wheel 4 is provided with a cross hole 44 at the bottom face for the actuating plate 11 of the lock 1 to pass through so as to make up mutual movement of the both.

Figure 3:
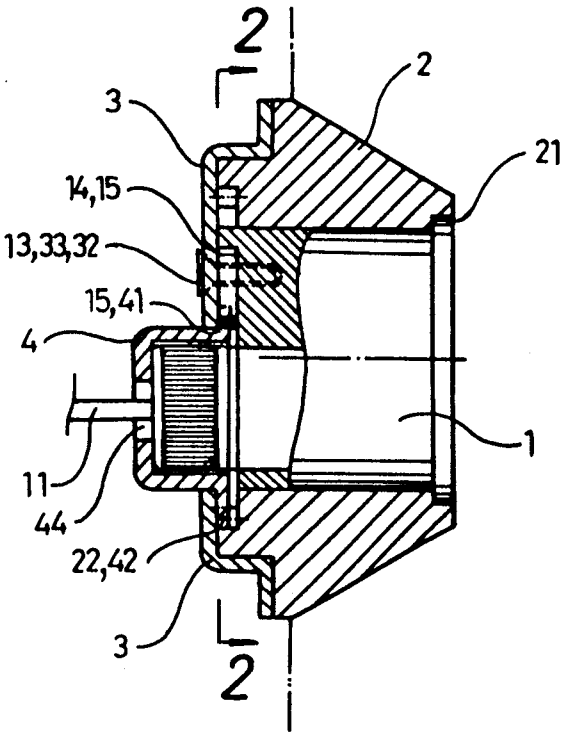
FIG. 3 is a cross-sectional taken along line 3—3 of FIG. 2.
Figure 2:
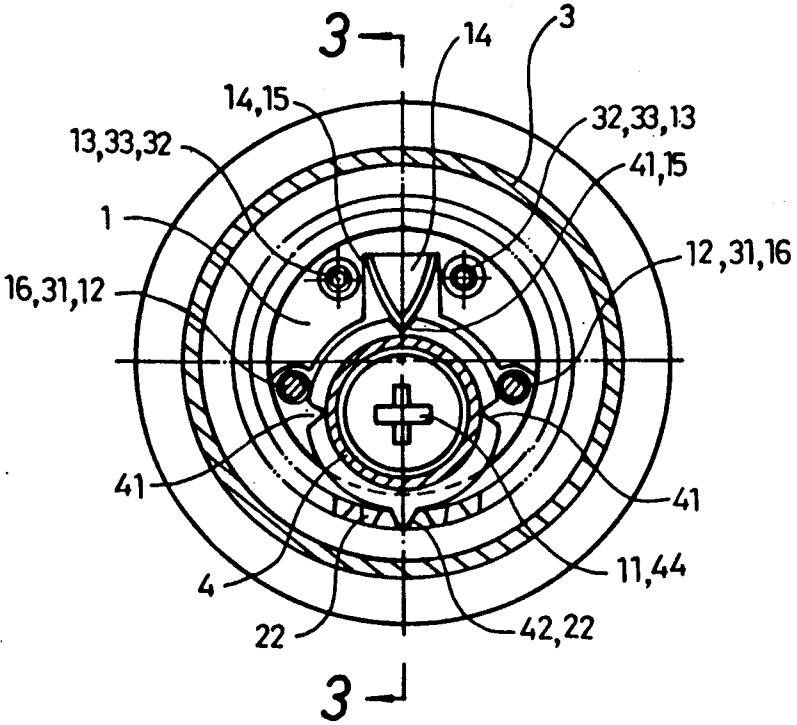
FIG. 2 is a cross-sectional taken along line 2—2 of FIG. 3.
Figure 5:
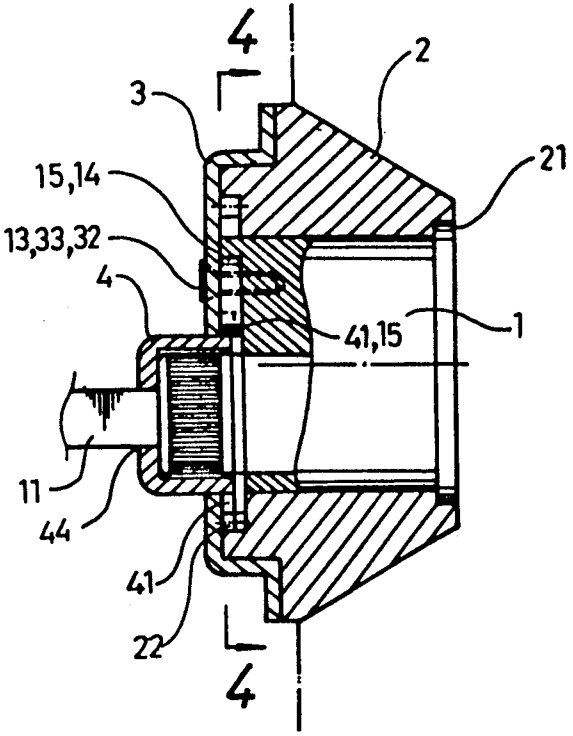
FIG. 5 is a cross-sectional taken along line 5—5 of FIG. 4.

As shown in FIGS. 2 and 3, after the lock 1 is assembled with the locking device in the present invention, they can be mounted in a door letting a large part of the rotatable ring 2 exposed outside the door, and fixed firmly with the screws 16, which pass through from the inside of the door to screw in the screw holes 12. The actuating plate 11 passes through the dead bolt and combined with the turning button inside, which is a well-known art, unnecessary to be drawn in the Figures. FIGS. 2 and 3 show the normal position of the lock 1 in the unlocked position, wherein the actuating plate 11 lies horizontally flat, and the V-shaped spring 15 has its pointed tip sticking in the middle one of the three notches 41, with the tooth 42 of the actuating wheel 4 engaging with one of the teeth 22 in the rotatable ring 2.

Figure 4:
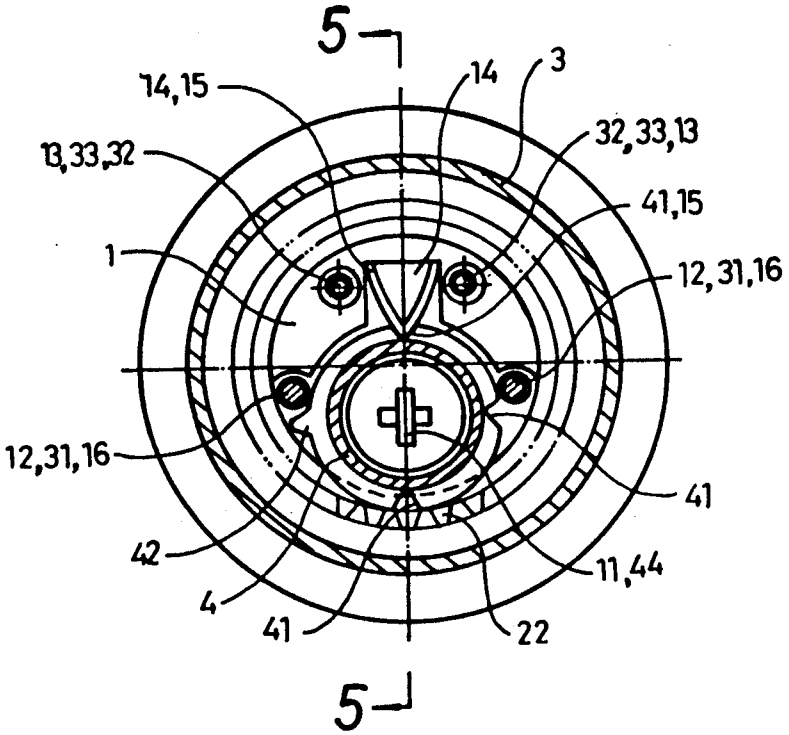
FIG. 4 is a cross-sectional taken along line 4—4 of FIG. 5.

Under this position the lock can be locked without a correct key from the outside of the door, and only turning the rotatable ring 2 can attain the purpose. Because the teeth 22 in the rotatable ring 2 can move the tooth 42 of the actuating wheel 4, which then is rotated, and has one of its three notches 41 to be stuck in by the tip of the V-shaped spring 15 as shown in FIG. 4 when said wheel 4 is rotated nearly 90°. Then the tooth 42 can separate from the teeth 22 at the location so that the rotatable ring 2 can no longer rotate the actuating ring wheel 4 to the result that said wheel 4 is only rotated for 90° and thereby the actuating plate 11 also rotates for 90° to cause the dead bolt to be extended out of the lock 1.

Under this position the lock can also be locked with a correct key, not using the rotatable ring 2 according to the traditional method. Because turning the key for 90° can directly rotate the actuating plate 11 for 90° and the FIG. 4 shows the position of 3 both, said plate, 11 and said wheel 4.

Under this position the lock can also be locked from the inside of a door by rotating the turning button for 90°, and then the actuating plate 11 can be directly rotated for 90° also together with the actuating wheel 4 as shown in FIG. 4.

Under this position the lock 1 cannot be unlocked by further rotation of the rotatable ring 2 in any direction once the lock 1 is locked according to any of the three ways just described. Because the tooth 42 of the actuating wheel 4 has already separated from the teeth 22 in the rotatable ring 2, and the actuating wheel 4 is being stuck firmly by the V-shaped spring so that the rotatable ring 2 can no more move the actuating wheel 4 to rotate. So, under this position, either a correct key from the outside or the turning button from the inside can be used to unlock it, turning the actuating plate 11 for 90° to recover the actuating wheel 4 to the open position shown in FIG. 2.

Additionally, this locking device can be applied to a door no matter whether it is to be opened to the right side or the left side, having the original convenience that rotation of the rotatable ring 2 can accomplish locking an auxiliary lock provided with this device from the outside of a door.

What is claimed is:

1. A locking device for an auxiliary lock comprising a rotatable ring, a base and an actuating wheel, said rotatable ring being provided with teeth around an inner peripheral edge for a tooth in the actuating wheel to engage with one of said teeth, said actuating wheel being provided with a cross-shaped hole for an actuating plate passing through a-dead bolt for mutual movement thereof, said rotatable ring being fitted around the lock and combined with the base at one vertical side to enable said ring to rotate said wheel, said tooth being separable from one of the teeth of the rotatable ring when said wheel is rotated 90°, said actuating wheel rotates the actuating plate 90° to extend the dead bolt for locking the lock when said wheel is rotated 90° by said ring.

2. The locking device for an auxiliary lock as claimed in claim 1, wherein the rotatable ring and the actuating wheel rotate on different axes and the inner peripheral face of said ring keeps contact with an outer peripheral face of said wheel so that rotation of said ring causes rotation of said wheel.

3. The locking device for an auxiliary lock as claimed in claim 1, wherein the mutual rotation of the rotatable ring and the actuating wheel can be clockwise or counterclockwise and the angle for mutual rotation is approximately 90°.

4. The locking device for an auxiliary lock as claimed in claim 1, wherein the actuating wheel has a flange which is provided with three notches spaced apart 90°, and a middle notch engages a pointed tip of a V-shaped spring so that the actuating wheel can be kept firmly immovable when the dead bolt is not extended .

5. The locking device for an auxiliary lock as claimed in claim 1, wherein the actuating wheel is provided with a cross-shaped hole for the actuating plate passing through the dead bolt to pass through for mutual movement.

6. The locking device for an auxiliary lock as claimed in claim 1, wherein the rotatable ring is provided with teeth around its inner peripheral face and the actuating wheel is provided with a tooth so, that said wheel can be rotated nearly 90° after the rotatable ring and the actuating wheel are assembled together by means of engagement of said tooth and said teeth, and the tooth of said wheel can separate from the teeth of said ring when said wheel is rotated 90°.

* * * * *